US012703946B2

(12) United States Patent
Ellis et al.

(10) Patent No.: US 12,703,946 B2
(45) Date of Patent: Aug. 11, 2026

(54) BIODEGRADABLE BOARDS AND METHODS OF MAKING THE SAME

(71) Applicant: Kraft Foods Schweiz Holding GmbH, Zug (CH)

(72) Inventors: Damian Ellis, Bournville (GB); Mike Jessop, Liversedge (GB); Leanne Oakley, Bournville (GB); Neil Shackleton, Liversedge (GB)

(73) Assignee: Kraft Foods Schweiz Holding GmbH, Zug (CH)

( * ) Notice: Subject to any disclaimer, the term of this patent is extended or adjusted under 35 U.S.C. 154(b) by 590 days.

(21) Appl. No.: 18/012,627

(22) PCT Filed: Jun. 17, 2021

(86) PCT No.: PCT/IB2021/000424
§ 371 (c)(1),
(2) Date: Dec. 22, 2022

(87) PCT Pub. No.: WO2021/260429
PCT Pub. Date: Dec. 30, 2021

(65) Prior Publication Data

US 2023/0250587 A1 Aug. 10, 2023

Related U.S. Application Data

(60) Provisional application No. 63/044,941, filed on Jun. 26, 2020.

(51) Int. Cl.
*D21H 11/02* (2006.01)
*D21H 15/02* (2006.01)
*D21H 21/52* (2006.01)

(52) U.S. Cl.
CPC ..... *D21H 11/02* (2013.01); *D21H 15/02* (2013.01); *D21H 21/52* (2013.01)

(58) Field of Classification Search
CPC ..... D21H 11/02; D21H 15/02; D21H 21/52
See application file for complete search history.

(56) References Cited

U.S. PATENT DOCUMENTS 5,293,726 A * 3/1994 Schick ..... E06B 3/7001 52/801.12
2011/0052881 A1* 3/2011 Netravali ..... C08L 89/00 428/179

(Continued)

FOREIGN PATENT DOCUMENTS

DE 19526541 3/1996
EP 2762637 8/2014

(Continued)

OTHER PUBLICATIONS

Daud, Zawawi, et al., "Cocoa Pod Husk and Corn Stalk: Alternative Paper Fibres Study on Chemical Characterization and Morphological Structures." Advanced Materials Research (2014), 911: 331-335.

(Continued)

*Primary Examiner* — Jacob T Minskey
*Assistant Examiner* — Stephen M Russell
(74) *Attorney, Agent, or Firm* — Fitch, Even, Tabin & Flannery LLP

(57) ABSTRACT

A biodegradable board having a high stiffness to weight ratio includes cocoa shell particles, cellulosic wood-based fibers, and no added binders. The cocoa shell particles may be sourced from a cocoa processing waste stream. The board has a grammage of at least about 2000 g/m$^2$. The board may be assembled into a self-supporting point-of-sale display unit for displaying food products.

19 Claims, 4 Drawing Sheets

(56) References Cited

U.S. PATENT DOCUMENTS

| | | | | |
|---|---|---|---|---|
| 2013/0199743 | A1* | 8/2013 | Lee | D21J 1/04 162/149 |
| 2015/0299957 | A1* | 10/2015 | Patane | C08B 15/00 162/175 |
| 2016/0089689 | A1* | 3/2016 | Cook | A47J 47/02 426/115 |
| 2016/0090207 | A1* | 3/2016 | Cance | B65D 19/06 108/57.16 |
| 2017/0174404 | A1 | 6/2017 | Ragot | |
| 2018/0207921 | A1* | 7/2018 | Zischka | D21H 19/00 |
| 2019/0145050 | A1* | 5/2019 | Rousseau | D21H 15/10 |
| 2019/0276636 | A1* | 9/2019 | Posada Correa | B32B 23/14 |

FOREIGN PATENT DOCUMENTS

| | | | | |
|---|---|---|---|---|
| EP | 2793599 | | 10/2014 | |
| EP | 3122941 | | 2/2017 | |
| EP | 3247741 | | 11/2017 | |
| EP | 3440260 | | 2/2019 | |
| EP | 3561179 | | 10/2019 | |
| EP | 3681652 | | 7/2020 | |
| FR | 3049620 | | 10/2017 | |
| JP | 2013100622 | | 5/2013 | |
| KR | 101447235 | | 10/2014 | |
| WO | 9809533 | | 3/1998 | |
| WO | 9945788 | | 9/1999 | |
| WO | WO-2010058084 | A1 * | 5/2010 | D21F 11/04 |
| WO | 2015144893 | | 10/2015 | |
| WO | 2016118826 | | 7/2016 | |
| WO | 2017174661 | | 10/2017 | |
| WO | 2017221055 | | 12/2017 | |
| WO | 2019053671 | | 3/2019 | |

OTHER PUBLICATIONS

Daud, Zawawi, et al.; "Chemical composition and morphological of cocoa pod husks and cassava peels for pulp and paper production"; Australian Journal of Basic and Applied Sciences (2013), 7 (9), pp. 406-411.

International Search Report and Written Opinion of the International Search Authority, date of mailing Oct. 22, 2021, International Application No. PCT/IB2021/000424, 10 pgs.

Liz-Anna's Studio: Make Your Own Paper from Plants; liz-annaslakesidestudio.blogspot.com/2010/06/papermaking-tutorial.html, Jun. 8, 2010, 17 pgs.

Lu, Fei, et al.; "Valorisation strategies for cocoa pod husk and its fractions"; Current Opinion in Green and Sustainable Chemistry (2018), 14, pp. 80-88.

* cited by examiner

BIODEGRADABLE BOARDS AND METHODS OF MAKING THE SAME

CROSS REFERENCE TO RELATED APPLICATIONS

This application is a U.S. national phase application of International Application No. PCT/IB2021/000424, filed Jun. 17, 2021, which claims benefit from Provisional Application 63/044,941, filed Jun. 26, 2020, which are each hereby incorporated herein by reference in their entirety.

FIELD

The present disclosure relates generally to biodegradable boards comprising cocoa shell particles and methods of making such products.

BACKGROUND

The production and processing of food products can result in byproducts or extraneous materials that form waste streams during processing. In some cases, the materials in these waste streams may be incinerated or discarded in landfills.

The materials used to package and display food products at the point of sale can also have an environmental impact. For example, paper products such as carboard and paperboard conventionally used to package and display food products at the point of sale are traditionally formed using wood pulp as a raw material. While certain paper-based materials can be recycled, the environmental impact of paper processing can be further abated by reducing the amount of wood pulp in these products even further.

SUMMARY

Described herein are biodegradable boards comprising cocoa shell particles and cellulosic wood-based fibers. Advantageously, the use of cocoa shell particles provides for a use of a material that is commonly discarded and can replace the use of other materials. This can lead to a reduced environmental impact.

The biodegradable boards are generally solid boards and may be particularly useful for packaging and displaying a food product at the point of sale. For example, the boards may be used to form self-supporting, free-standing display units. Traditionally, point-of-sale displays may be made of corrugated carboard, paperboard, and the like. The biodegradable boards described herein are significantly stronger and more rigid than conventional paper-based materials used to form point-of-sale displays. In some exemplary approaches, the boards have a thickness of about 0.75 mm to about 60 mm, grammage of at least about 2000 g/m$^2$, and/or a density from about 1000 kg/m$^3$ to about 1100 kg/m$^3$. The boards include an amount of cocoa shell particles and cellulosic wood-based fibers and contain no added binders. In some approaches, the boards generally include less than 50% cocoa shell particles, and in some approaches from about 30% to about 45% cocoa shell particles, which may have a particle size of no more than about 1 mm. The cocoa shell particles may be obtained from a cocoa processing waste stream. In some approaches, the cellulosic wood-based fibers may be sourced from recycled materials or other wood or paper-based waste materials.

In some embodiments, at least one outer surface or skin of the board may have a degree of undulation. For example, one outer skin may have dimpled texture or appearance, while, in some approaches, the other outer skin may have a smoother texture or appearance. The outer skin having the smoother surface or appearance may be especially suited for accepting inks, which may be used to print product details on the board, although both outer skins may be printable. In some approaches, the board may be configured such that its outer surfaces or skins have a higher density and/or hardness than its inner or middle portion. Additionally, the board may be configured to have less than about 0.1% rub-off of the cocoa shell particles (which can be tested using cellophane tape).

Methods of making biodegradable boards may comprise, for instance, providing cocoa shells, which may be sourced from a cocoa processing waste stream. The cocoa shells are ground to suitable particle size, for instance, a particle size of no more than about 1 mm. In a second stream, cellulosic wood-based material is provided, which is mechanically pulped, for example, using hot water and one or more mixing blades.

The ground cocoa shell particles are combined with the pulp from the cellulosic wood-based waste material to form a pulp mixture. The pulp mixture is poured into a mold and then compressed with the application of heat using, for example, a press having a mesh bottom surface to form a dry sheet having a moisture content of less than about 4%. In one approach, the plate and the mesh bottom surface are heated. Moisture, which may be liquid and/or steam, is dispelled through the mesh bottom surface.

In some approaches, the biodegradable boards may comprise 100% recycled and/or waste material and contain no added binders.

The methods described herein provide biodegradable boards having surprising strength and structural integrity without the need for additional chemicals or binders. It is believed this is due to the high level of intertwining between the cocoa shell particles and the wood-based cellulose fibers. In some approaches, the cocoa shell particles and wood-based cellulosic fibers are sufficiently intertwined to form a board having a rupture strength or modulus of rupture of at least about 350 psi to about 7500 psi, and in some approaches at least 400 psi. The board may have modulus of elasticity of about 700,000 psi to about 1,000,000 psi, and more preferably of about 800,000 psi to about 900,000 psi, for example, about 873,000 psi. The board may have a tensile strength of about 4000 psi to about 7000 psi, and more preferably of about 5000 psi to about 6000 psi, for example, about 5677 psi.

The biodegradable boards described herein are particularly useful in various point-of-sale displays, wherein—due to their high strength and structural integrity—they may be assembled or otherwise used for packaging or displaying food products in a retail or commercial environment. For example, the boards may be assembled into a self-supporting, free-standing display unit that includes at least one shelf for displaying a product. In some approaches, one or more boards may be assembled into packaging or a display unit for a food product or class of food products from which the waste stream used to form the boards was sourced. For example, biodegradable boards may be formed using a waste stream of cocoa shells sourced from producing cocoa used in a particular brand or line of chocolate confectionary bar, and those boards may be assembled into a self-supporting point-of-sale display comprising at least one shelf for displaying that same brand or line of chocolate confectionary bar.

The self-supporting point-of sale display unit can be made of the boards described herein, and can be used for displaying products. When the product to be displayed on the display unit is dark chocolate or a dark chocolate-based product, the cellulosic wood-based fibers can include recycled unbleached cardboard and, more preferably, include at least half recycled unbleached cardboard by weight of the cellulosic wood-based fibers and, optionally, are entirely recycled unbleached cardboard. When the product to be displayed on the display unit is milk chocolate or a milk chocolate-based product, the cellulosic wood-based fibers can include recycled deinked and/or bleached office paper and, more preferably, include at least half recycled deinked and/or bleached office paper by weight of the cellulosic wood-based fibers and, optionally, are entirely recycled deinked and/or bleached office paper. These are examples of how the color or appearance of the display can be correlated to the product to be displayed.

In this way, closed loop recycling of food processing waste into packaging and display materials used at the point of sale can improve the environmental footprint and sustainability of food products, while also supporting a brand's environmental awareness and responsibility as recognized by consumers.

BRIEF DESCRIPTION OF THE DRAWINGS

Disclosed herein are embodiments of products and methods pertaining to biodegradable boards. This description includes drawings, wherein.

DETAILED DESCRIPTION

The aforementioned summary and the following description are not to be taken in a limiting sense, but are made merely for the purpose of describing the general principles of exemplary embodiments and approaches. Reference throughout this specification to "one approach," "an approach," "some approaches", or similar language means that a particular feature, component, property, or characteristic described in connection with the approach is included in at least one approach of the present invention. Thus, appearances of the phrases "in one approach," "in an approach," "in some approaches", and similar language throughout this specification may, but do not necessarily, all refer to the same embodiment. In fact, it should be understood that a particular feature, component, property, or characteristic described herein with respect to one or more approaches or embodiments is combinable with any other feature, component, property, or characteristic described herein in any combination unless explicitly stated otherwise.

Percentages used herein are by weight except as otherwise indicated.

The present disclosure describes biodegradable boards comprising cocoa shell particles and cellulosic wood-based fibers. In some approaches, the cocoa shells may be sourced from a cocoa processing waste stream. A non-limiting example of a conventional commercial cocoa processing method is illustrated in FIG. 1.

Figure 1:
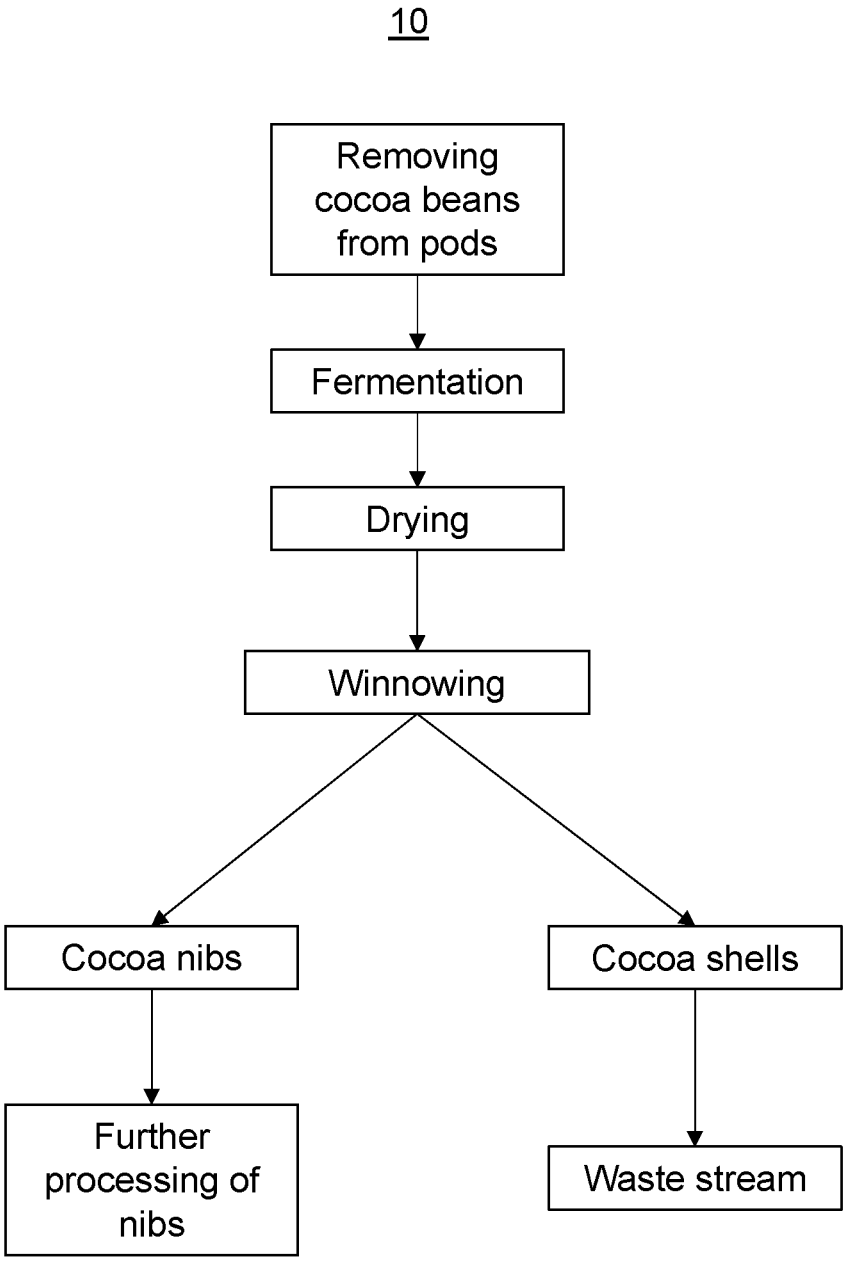
FIG. 1 is a process flow diagram of a conventional cocoa processing method.

With reference to FIG. 1, cocoa processing generally begins when the cocoa beans are removed from harvested cocoa pods. As understood by those skilled in the art, cocoa pods generally comprise an outer husk and an inner pulp or mucilage, which houses the cocoa beans. Following removal of the cocoa beans from the pods, the beans may be fermented and dried to begin the development of a suitable chocolate flavor. The cocoa beans are then winnowed to separate the outer cocoa shell from the inner cocoa bean, which is commonly referred to as a "nib" or "cocoa nib". In some approaches, the winnowing process may be conducted with the application of heat.

The separated nibs may then be further processed by roasting, grinding, pressing, etc., depending on their intended use. The cocoa shells can form a waste stream, which is oftentimes discarded. The cocoa shells in the waste stream are particularly useful as a raw material for the biodegradable boards described herein.

While the cocoa shells used to form the biodegradable boards described herein are preferably obtained from a cocoa processing waste stream to enhance sustainability, possible sources of the cocoa shells are not limited to commercial cocoa processing streams. It should also be noted that the cocoa beans from which the shells are obtained to form the biodegradable boards described herein need not be subjected to each and every processing step depicted in the exemplary process illustrated in FIG. 1. Instead, FIG. 1 is intended to illustrate one example of how cocoa beans may be commercially processed and at what point cocoa shells may be separated from the cocoa nibs.

The shells will generally undergo further processing to make them suitable for use in the boards. In one approach, the cocoa shells are cleaned and ground or refined to a desired size. For example, the shells may be refined to a particle size of no more than about 1 mm.

The biodegradable boards generally include less than 50% of the cocoa shell particles. In some approaches, the boards may include from about 30% to about 45% cocoa shell particles, and in some approaches from about 35% to about 45% cocoa shell particles. The amount of cocoa shell particles included in the board can depend on the intended use and desired properties of the board. However, the inventors found that including too much of the cocoa shell particles can cause the sheet to lose its cohesiveness, resulting in a board having reduced strength and structural integrity.

The biodegradable boards described herein also include an amount of cellulosic wood-based fibers. Exemplary cellulosic wood-based fibers may include, but are not limited to, material from the from the bark, wood, or leaves of any suitable plant or tree. In some approaches, the cellulosic wood-based fibers may be provided by, or may include, recycled paper-based products such as, for example, recycled paper, carboard, paperboard, and the like. In some approaches, the boards may include from more than 50% to about 70% of the cellulosic wood-based fibers. In some approaches, the amounts of cocoa shell particles and cellulosic wood-based fibers in the boards may be such that the boards contain 100% recycled material or material typically considered to be waste, e.g., cocoa shells and cellulosic wood-based fibers.

Notably, the biodegradable boards described herein do not require any additives beyond the cocoa shells and cellulosic fibers (and, in some approaches, water). For example, the biodegradable boards can be made without any added binders to bind the refined cocoa shells and cellulosic fibers together in the board. Instead, the components are believed to be bound together by the intertwining of the cocoa shell particles and the cellulose fibers such that the board has suitable strength and structural integrity. For example, in one approach, the boards have suitable strength and structural integrity to be formed into free-standing point-of-sale display units capable of supporting and displaying food products. Advantageously, the food products can be cocoa-based, thereby exemplifying a circular economy with respect to chocolate products and production.

The biodegradable boards are preferably, though not necessarily, single-layer composite boards. In other words, they are not a lamination of separately formed materials. The outer portions or skins of the board are generally more compacted than the inner portions due to the application of heat on the outer surfaces during production of the sheets that comprise the board or the boards cut from the sheets.

Figure 2:
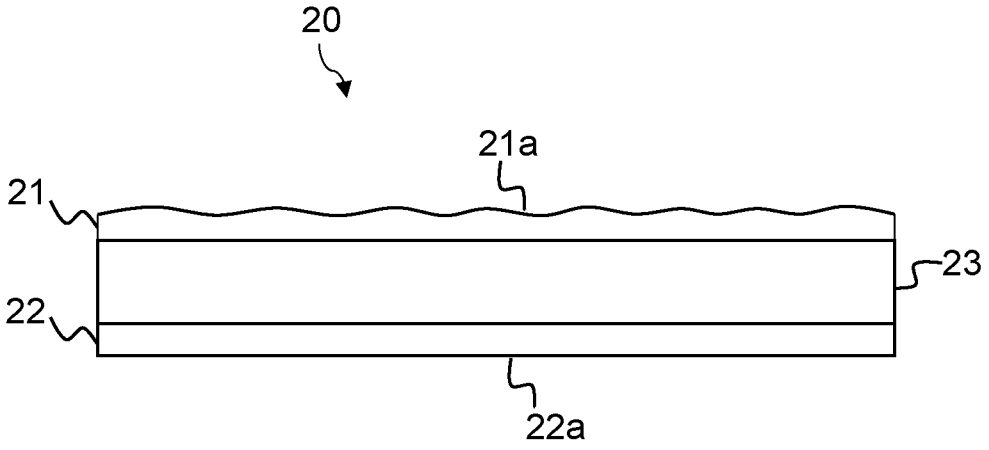
FIG. 2 is a side view of an exemplary single-layer biodegradable board in accordance with some embodiments.

As illustrated in FIG. 2, an exemplary board 20 includes a first outer skin 21 and a second outer skin 22 opposite the first outer skin. The board further includes an inner portion 23 between the first and second outer skins. In some approaches, the first outer skin 21 and/or the second outer skin 22 may have a higher density than the inner portion 23. It will be appreciated that the illustrated board 20 may not have the precise linear separation illustrated between the skins 21 and 22 and the inner portion 23.

In some approaches, one or both of the board's outer surfaces or skins may have a degree of undulation. For instance, in the non-limiting example illustrated in FIG. 2, the first outer skin 21 may comprise a dimpled surface 21*a* and the second outer skin may comprise a smoother surface 22*a* than the dimpled first surface 21*a*. It should be understood that both outer surfaces or skins may have similar texture, smoothness, coarseness, undulation, etc., which can be modified and/or refined as needed during or after production of the sheets. They can also be embossed, either during or after forming.

Since an intended use of the biodegradable boards is for packaging and/or displaying food products, it is desirable that one or both of the outer surfaces or skins of the board may be capable of accepting a variety of inks that may be used to print product information, artwork, and the like. Thus, in some approaches, one or both of the outer surfaces or skins may be printable such that they are capable of accepting any suitable inks, such as water-based inks.

The boards generally have a thickness of about 0.75 mm to about 60 mm, depending on the intended use of the boards. For example, in some approaches, the board may have a thickness of about 2.5 mm. Additionally, the boards have a grammage of at least about 2000 g/m$^2$, considerably higher than corrugate, paperboard, and the like. In some approaches, the board may have a density of about 1000 kg/m$^3$ to 1100 kg/m$^3$, for example 1067 kg/m$^3$. The board may have a rupture strength or modulus of rupture of at least about 350 psi to about 7500 psi, and in some approaches at least 400 psi. The board may have modulus of elasticity of about 700,000 psi to about 1,000,000 psi, and more preferably of about 800,000 psi to about 900,000 psi, for example, about 873,000 psi. The board may have a tensile strength of about 4000 psi to about 7000 psi, and more preferably of about 5000 psi to about 6000 psi, for example, about 5677 psi.

In an exemplary embodiment, the boards described herein may have one or more of the properties listed in the table below (suitable test methods include ASTM D1037, EN 310, EN317, EN 319 and EN 323):

TABLE 1

| Property | Metric | Imperial |
|---|---|---|
| Grammage | 2166.7 g/m$^2$ | 7.1 oz/ft$^2$ |
| Density | 1067 kg/m$^3$ | 66.6 lb/ft$^3$ |
| Modulus of rupture | 48.5 MPa | 7,033 psi |
| Modulus of elasticity | 6020 MPa | 873,000 psi |
| Tensile strength | 39.1 MPa | 5,677 psi |
| Internal bond | 0.492 MPa | 71.4 psi |
| Thickness swell | 64.6% | 64.6% |
| Linear expansion | 0.194% | 0.194% |
| Fire rating | Class A | Class A |
| Formaldehyde and CREL emissions | None | None |

Additionally, it is desirable that the cocoa shell particles do not excessively rub off of the biodegradable boards when handled. Thus, in some approaches, the boards are configured to have no more than about 0.1% rub-off of the cocoa shell particles. The degree of rub off may be tested using cellophane tape.

Figure 3:
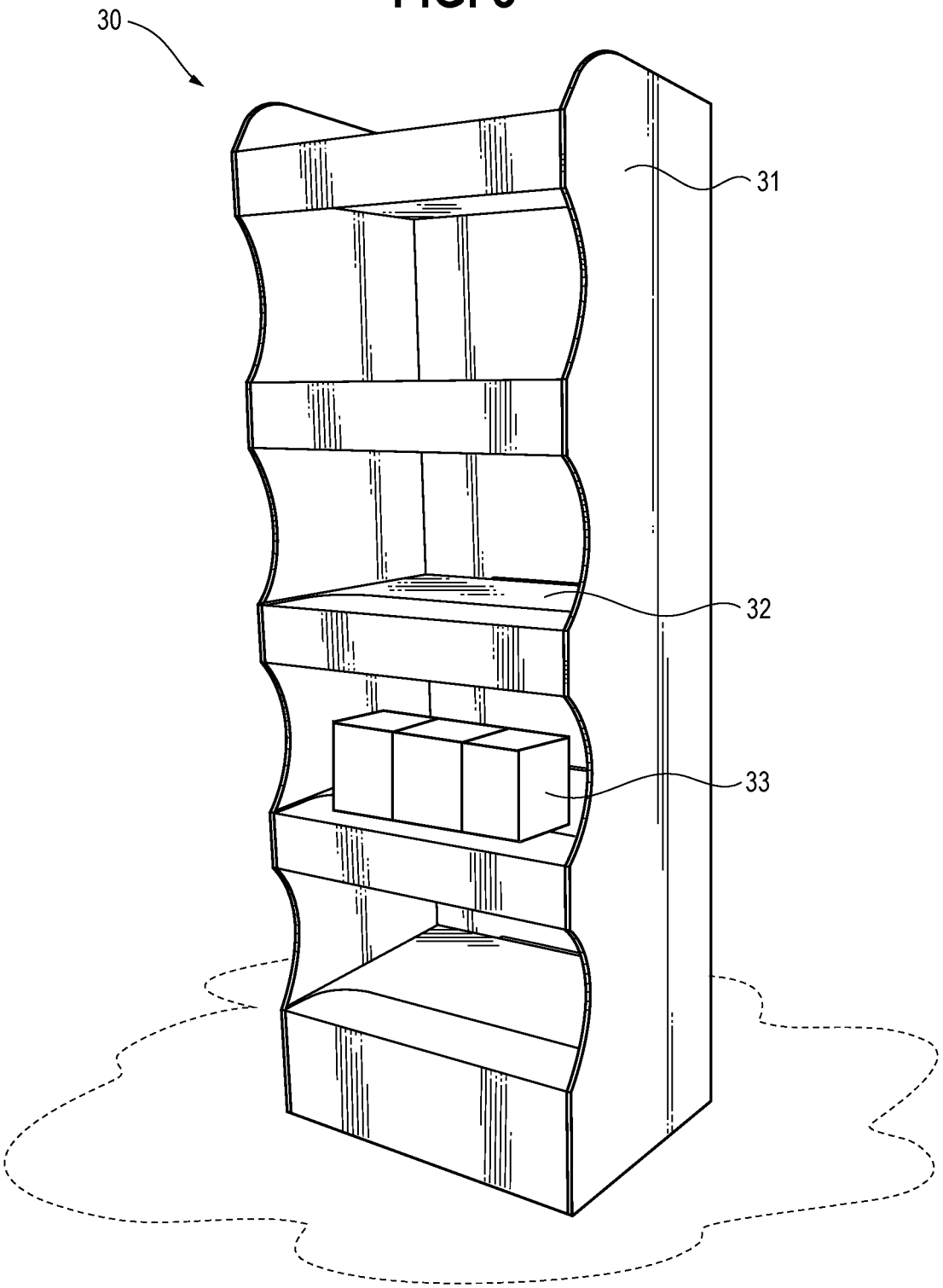
FIG. 3 is an illustration of a self-supporting, free-standing display unit in accordance with some embodiments.

As described above, the cohesiveness of the components in the biodegradable boards provides sufficient strength and structural integrity such that the boards may be assembled into packaging and/or point-of-sale displays. Examples of point-of-sale displays (which may also be known as "point-of-purchase" displays) may include endcap displays, side-kick displays, power wing displays, floor displays, counter displays, display bins, case stackers, inline displays, and the like. In some approaches, one or more of the biodegradable boards may be assembled into a self-supporting, free-standing display unit having at least one shelf for displaying one or more food products. An exemplary display unit is illustrated in FIG. 3. The display unit 30 in FIG. 3 is a self-supporting, free-standing style of point-of-sale floor display unit comprising side panels 31 and shelves 32, which are configured to display products 33 (which, in some approaches, can be chocolate or chocolate-based products contained in packages or cartons).

In some approaches, the display unit may be used to display a food product or class of food products from which the waste stream used in forming the boards was sourced. For example, the biodegradable boards may be formed using a waste stream of cocoa shells sourced from producing cocoa used in a particular brand or line of chocolate confectionary bar. And the boards may be assembled into a self-supporting, free-standing display unit for displaying that same brand or line of chocolate confectionary bar.

The incorporation of cocoa shells as a raw material into the boards used to form the point-of-sale displays for associated food products provides point-of-sale displays having sufficient strength and structural integrity for displaying such products. Additionally, the use of cocoa shell waste material in combination with paper-based waste material improves the sustainable footprint of the material used to produce and display the products.

Figure 4:
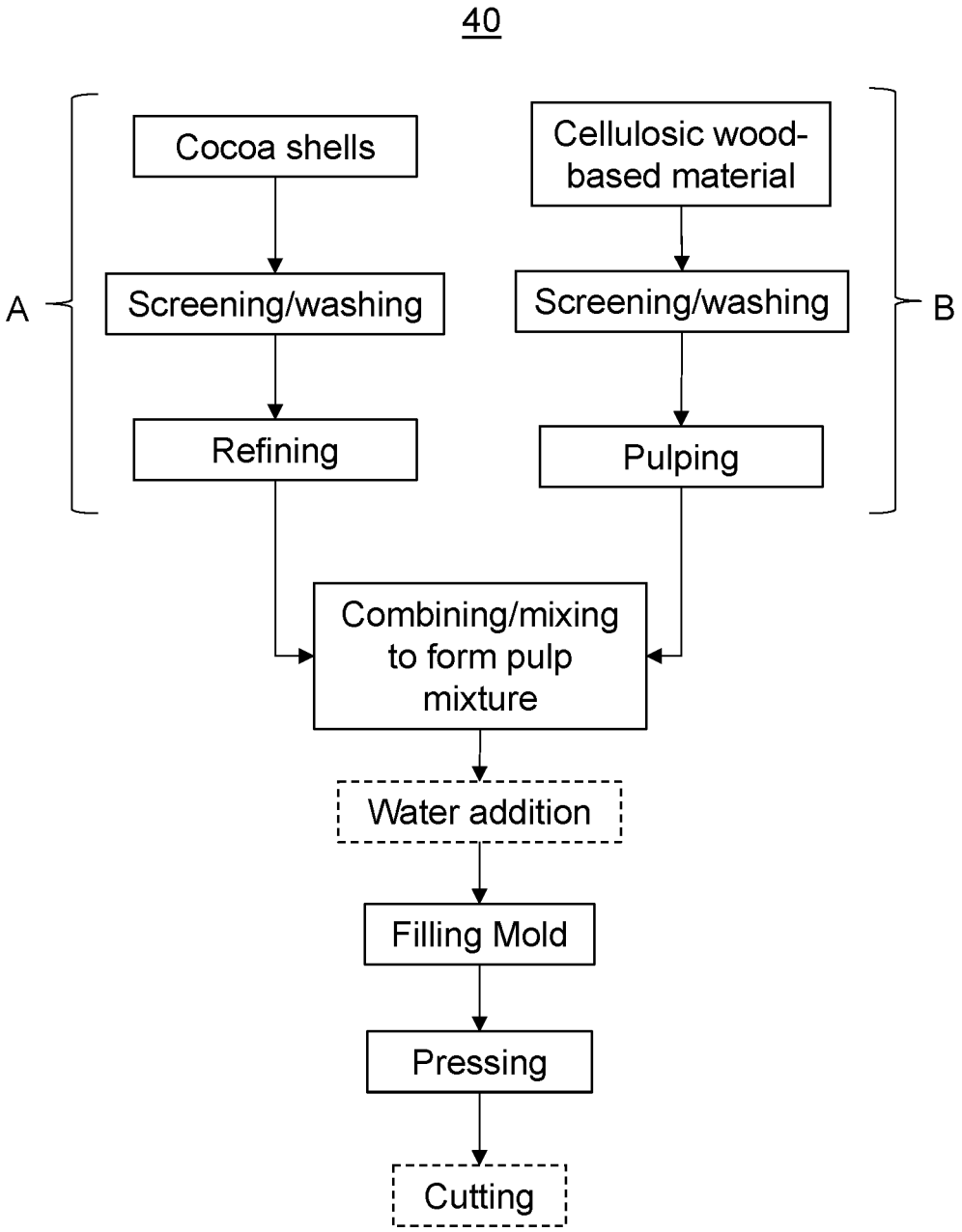
FIG. 4 is a process flow diagram of an embodiment of a method of making a biodegradable board in accordance with some embodiments.

Also described herein are methods of making biodegradable boards. An exemplary method 40 of making biodegradable boards is illustrated in FIG. 4. The method includes providing cocoa shell material processed in a first stream (A) and cellulosic wood-based fibers processed in a second stream (B).

As discussed above, cocoa beans are obtained from harvested cocoa pods and the beans are processed in a manner to separate the cocoa shells from the cocoa nibs. The separated nibs may then be further processed by roasting, grinding, pressing, etc., depending on their intended use, and the cocoa shells form a waste stream which is oftentimes discarded.

The cocoa shells in stream A may undergo further processing so that the shells are suitable for use in forming the biodegradable boards. For example, with reference to FIG. 4, the cocoa shells may be screened and rinsed to clean and remove any unwanted foreign materials such as, for example, stones, dirt, etc. Screening may be performed using any appropriate technique and the shells may be rinsed with water at ambient temperature. Importantly, the cocoa shells are not subjected to alcohols, acids, or other chemical solvents during rinsing. The rinsing step may be very brief, e.g., less than 10 seconds or about 5 seconds.

The cocoa shells are then ground/refined to a suitable particle size. In some approaches, the cocoa shells may be ground/refined using a disk refiner. In some approaches, the distance between the disks of the disk refiner may be from 0.04 mm to about 0.64 mm. Preferably, the cocoa shells are ground to a particle size of no more than about 1 mm. It was found that using cocoa shells refined to have a particle size of no more than about 1 mm enables the use of higher amounts of cocoa shells while still achieving a usable board.

In a separate stream (illustrated as stream B in FIG. 4), cellulosic wood-based material is provided. As described herein, exemplary cellulosic wood-based material may include, for example, material from the from the bark, wood, or leaves of any suitable plant or tree. In some approaches, the cellulosic wood-based material may include material from recycled paper-based items, such as, for example, cardboard, paper, and the like. In some approaches, all, or substantially all, of the cellulosic wood-based material in this stream may be in the form of recycled material and/or recycled pulp.

The cellulosic wood-based material may be screened and washed to remove any foreign material, as needed. Once the cellulosic wood-based material is suitably cleaned and refined, the material is then pulped using any suitable pulping technique. The material may be mechanically pulped to release the cellulosic fibers. In some approaches, the material may be mechanically pulped using hot water and one or more mixing blades.

The pulped cellulosic material is then combined with the ground cocoa shell particles to form a pulp mixture. The pulp mixture may include less than 50% of the cocoa shell particles, from about 30% to about 45% cocoa shell particles, and in some approaches from about 35% to about 45% cocoa shell particles, with the balance being cellulosic wood-based waste material on a dry weight basis.

In some approaches, water may already be present in the refined cocoa shells and/or the cellulose sufficient for the pressing process to be performed, or water may need to be added. The amount of water added may depend on the amount of water already contained in the raw materials.

The pulp mixture is then fed into a forming device (e.g., a mold) which forms a thick mat of fibers dewatered to a suitable dry matter content. Dewatering may be accomplished, for example, by the application of pressure and heat using a hot press. In some approaches, the pressing device used to hot press the fiber mats may include a bottom surface formed of a mesh material. In some approaches, the plate and mesh bottom surface of the press are heated. Hot pressing may be conducted at a temperature of about 150° F. to about 200° F. and at a pressure of about 350 psi for about 20 minutes. Moisture, which may be liquid and/or steam, is dispelled through the mesh bottom surface of the hot press. For example, the press can be a multi daylight press with thermal oil heated top and bottom plates.

In some approaches, dewatering during hot pressing can achieve a suitable moisture content. In other approaches, the pressed sheets may be further heated or dried to achieve a suitable moisture content. Generally, it is desirable for the sheets to have a moisture content of less than about 4%, in some approaches less than about 3%, and in some approaches less than about 2%.

The conditions of the hot-pressing process are effective to achieve single-layer composite boards having a thickness of about 0.75 mm to about 60 mm and a grammage of at least about 2000 g/m$^2$. Without wishing to be bound by theory, it is believed the hot-pressing process described herein enables the formation of hydrogen bonds between the cellulose fibers, allowing for the production of composite board having high strength and structural integrity.

Additionally, the heat and pressure parameters are effective so that the upper and lower outer skins of the sheet are more compacted as compared to the sheet's center or middle portion. In some approaches, the mesh bottom surface of the press may cause the sheet's lower outer surface or skin to have a dimpled texture or appearance, while the upper surface of the press may cause the upper outer surface or skin of the sheet to have a smoother texture or appearance. While the smoother outer surface may be especially suited as a printing surface, one or both outer surfaces may be printable such that they are capable of accepting any suitable inks.

Following hot pressing and/or further drying, the sheets may be cooled to prevent them from curving during handling. The board can comprise the sheet if in its final shape, or the board or multiple boards can be cut from the sheet.

Notably, processing the cocoa shells and recycled cellulosic wood-based material, along with water, as described above may be accomplished using mechanical techniques, and do not require or include the use of chemical solvents or additives, nor are added binders needed to bind together the components of sheet. Instead, the methods described herein are believed to achieve a high level of intertwining between the cocoa shell particles and cellulose fibers, which provides a biodegradable sheet and resultant board or boards having surprising strength and structural integrity without the need for added binders.

In some approaches, the boards may undergo further processing to refine or modify one or more of the sheet's outer surfaces or skins, if needed. The sheet may also be scored or cut to boards of desired sizes and shapes depending on their intended uses. As discussed above, in some approaches, the boards may be assembled into free-standing display units for displaying food products and, as such, the sheets may be further processed, cut, and/or shaped accordingly.

In some approaches, the boards or sheets may be subjected to a printing process using any suitable ink(s). Alternatively, or additionally, the sheets or resultant board or boards may be coated with a biodegradable coating material or film using any suitable technique, such as, for example, roller coating, dip coating, and the like. In one non-limiting example, the boards may be coated with a colored film by roller coating. In another non-limiting example, a coating material may be applied to the boards by dip coating to enhance the boards' printability.

The color of the biodegradable boards can vary depending on, in part, the type and color of wood-based cellulose material, or non-cocoa shell cellulose material, that is used. For example, if recycled bleached material is used-such as recycled office paper, the boards can have a lighter color or appearance than if recycled unbleached material is used-such as recycled, unbleached cardboard. Of course, mixes of recycled material types can be used to customize the color or appearance of the boards. Advantageously, the color or appearance of the board can be correlated to a product associated with the board. If the boards are made into packaging or displays for chocolate or chocolate-based products, then the color or appearance of the boards can be correlated to the type of chocolate or chocolate-based products. For example, if the boards are assembled into a point of sale display for milk chocolate or milk-chocolate-based products, then a lighter color or appearance of the boards can be selected; if the boards are assembled into a point of sale display for dark chocolate or dark-chocolate-based products, then a darker color or appearance of the boards can be selected. For example, the wood-based cellulose could be unbleached cardboard when the point of sale display is for dark chocolate or dark chocolate-based products. Also by way of example, the wood-based cellulose could be bleached and deinked office paper when the point of sale display is for milk chocolate or milk chocolate-based products.

While the method described above with respect to FIG. 4 describes the use of cocoa shell particles as a raw material for the biodegradable boards, it is also contemplated that some or all of the cocoa shell particles may be replaced with other waste material from food processing streams, provided the food waste material can be sufficiently processed and refined so that ground particles are highly intertwined with the cellulosic material to achieve a board having similar grammage, rupture strength, stiffness to weight ratio, hardness, and/or a modulus of a similar board comprising the cocoa shell particles.

Example 1

A biodegradable board was formed as provided below.

Cocoa shells were obtained from a cocoa processing waste stream. The cocoa shells were screened and briefly rinsed in water at ambient temperature. The rinsed cocoa shells were then refined using a 12-inch disk refiner with D2 A-505 disks having a distance between the disks of 0.04 mm to 0.64 mm. The cocoa shells were refined to a particle size of no more than about 1 mm.

In a separate stream, recycled wood-based material was obtained. The recycled wood-based material was screened, rinsed, and mechanically pulped.

A pulp mixture was formed by combining 35% of the cocoa shell particles and 65% of the recycled pulp material. Water was added to the pulp mixture to obtain a dry matter content of about 1% to about 2%.

The pulp mixture was fed into a mold and hot-pressed at 150° F. to 200° F. at 350 psi for 20 minutes to a moisture content of less than 4% and then cooled.

The resulting board contained 100% recycled waste and/or waste material.

Example 2

An exemplary board containing 35% cocoa shell particles and 65% recycled pulp and having a thickness of 2.5 mm was produced according to the method illustrated in Example 1. The board exhibited the following properties (suitable test methods include ASTM D1037, EN 310, EN317, EN 319 and EN 323):

TABLE 2

| Property | Metric | Imperial |
|---|---|---|
| Grammage | 2166.7 $g/m^2$ | 7.1 $oz/ft^2$ |
| Density | 1067 $kg/m^3$ | 66.6 $lb/ft^3$ |
| Modulus of rupture | 48.5 MPa | 7,033 psi |
| Modulus of elasticity | 6020 MPa | 873,000 psi |
| Tensile strength | 39.1 MPa | 5,677 psi |
| Internal bond | 0.492 MPa | 71.4 psi |
| Thickness swell | 64.6% | 64.6% |
| Linear expansion | 0.194% | 0.194% |
| Fire rating | Class A | Class A |
| Formaldehyde and CREL emissions | None | None |

The matter set forth in the foregoing description and accompanying drawings is offered by way of illustration only and not as a limitation. While particular embodiments have been shown and described, it will be apparent to those skilled in the art that a wide variety of other modifications, alterations, and combinations can also be made with respect to the above described embodiments without departing from the scope of the invention, and that such modifications, alterations, and combinations are to be viewed as being within the ambit of the inventive concept.

What is claimed is:

1. A biodegradable board comprising:

from about 35% to about 50% cocoa shell particles;

cellulosic wood-based fibers; and no added binders, wherein the biodegradable board is formed of a single layer, and has a density from about 1000 $kg/m^3$ to about 1100 $kg/m^3$.

2. The biodegradable board of claim 1, wherein the cocoa shell particles have a particle size of no more than about 1 mm.

3. The biodegradable board of claim 1, further comprising a thickness of about 0.75 mm to about 60 mm and a grammage of at least about 2000 $g/m^2$.

4. The biodegradable board of claim 1, comprising about 35% to about 45% of the cocoa shell particles.

5. The biodegradable board of claim 1, further comprising a moisture content of less than about 4%.

6. The biodegradable board of claim 1, further comprising a rupture strength of at least about 350 psi.

7. The biodegradable board of claim 1, further comprising a modulus of elasticity of about 700,000 psi to about 1,000,000 psi and a tensile strength of about 4000 psi to about 7000 psi.

8. The biodegradable board of claim 1, further comprising an outer skin and an inner portion, wherein the outer skin is more dense than the inner portion.

9. The biodegradable board of claim 1, further comprising a dimpled first outer skin and a smoother second outer skin opposite the dimpled first dimpled outer skin.

10. The biodegradable board of claim 1, wherein the board has less than about 0.1% rub-off of the cocoa shell particles.

11. The biodegradable board of claim 1, wherein:

the cocoa shell particles are obtained from cocoa shells sourced from a cocoa processing waste stream, and the biodegradable board is assembled into a point-of-sale display unit for displaying a cocoa-containing food product.

12. A method of making a biodegradable board, the method comprising:

grinding cocoa shells sourced from a cocoa processing waste stream;

providing pulp from cellulosic wood-based waste material;

combining the ground cocoa shells with the pulp from cellulosic wood-based waste material to form a mixture;

compressing the mixture under heat to form a biodegradable board, wherein the biodegradable board comprises from about 35% to about 50% cocoa shell particles, and the biodegradable board is formed of a single layer, and has a density from about 1000 kg/m$^3$ to about 1100 kg/m$^3$.

13. The method of claim 12, wherein the biodegradable board comprises about 35% to about 45% of the cocoa shell particles.

14. The method of claim 12, wherein the compressing is effective to form a biodegradable board having a rupture strength of at least about 350 psi.

15. The method of claim 12, wherein the compressing is effective to form a biodegradable board having a thickness of about 0.75 mm to about 60 mm and a grammage of at least about 2000 g/m$^2$.

16. The method of claim 12, wherein the compressing is effective to form a biodegradable board having a modulus of elasticity of about 700,000 psi to about 1,000,000 psi and a tensile strength of about 4000 psi to about 7000 psi.

17. The method of claim 12, further comprising drying the biodegradable board to a moisture content of less than about 4% and wherein the cocoa shells are ground to a particle size of no more than about 1 mm.

18. The method of claim 12, wherein the biodegradable board contains no added binders.

19. A self-supporting point-of-sale display unit comprising one or more biodegradable boards, each biodegradable board having a grammage of at least about 2000 g/m$^2$ and comprising:

from about 35% to about 50% cocoa shell particles;

cellulosic wood-based fibers; and no added binders, wherein the biodegradable board is formed of a single layer, and has a density from about 1000 kg/m$^3$ to about 1100 kg/m$^3$.

* * * * *